United States Patent [19]

Lach

[11] 4,411,250

[45] Oct. 25, 1983

[54] TRUEING TOOL

[76] Inventor: Horst Lach, Dammstrasse 5, D-6450 Hanau, Fed. Rep. of Germany

[21] Appl. No.: 256,585

[22] Filed: Apr. 22, 1981

[30] Foreign Application Priority Data

Apr. 30, 1980 [DE] Fed. Rep. of Germany ..... 3016740

[51] Int. Cl.[3] ..... B24B 53/00

[52] U.S. Cl. ..... 125/11 CD; 125/11 R

[58] Field of Search ..... 125/11 R, 11 CD; 51/206.5, 206 P, 206 R; 407/55, 58, 60

[56] References Cited

U.S. PATENT DOCUMENTS 667,304 2/1901 Feix ..... 51/206.5
1,828,740 10/1931 Legge ..... 51/206.5
3,451,721 6/1969 Highberg et al. ..... 51/206 R
3,701,187 10/1972 Erkfritz ..... 407/58 X
3,916,579 11/1975 Waller et al. ..... 51/206 P

*Primary Examiner*—James G. Smith
*Assistant Examiner*—Willmon Fridie
*Attorney, Agent, or Firm*—Dennison Meserole, Pollack & Scheiner

[57] ABSTRACT

A trueing tool with a profile being composed of profiled plates formed of hard or superhard material, which are arranged in spaced relation to each other. The hard material is preferably polycrystalline, synthetic diamond processed by means of spark erosion.

The trueing tool may be in the form of a roller consisting of segments spaced from each other on the circumferential surface of a shaft body, with profiled plates being arranged on the breast surfaces of said segments.

2 Claims, 4 Drawing Figures

TRUEING TOOL

Figure 1:
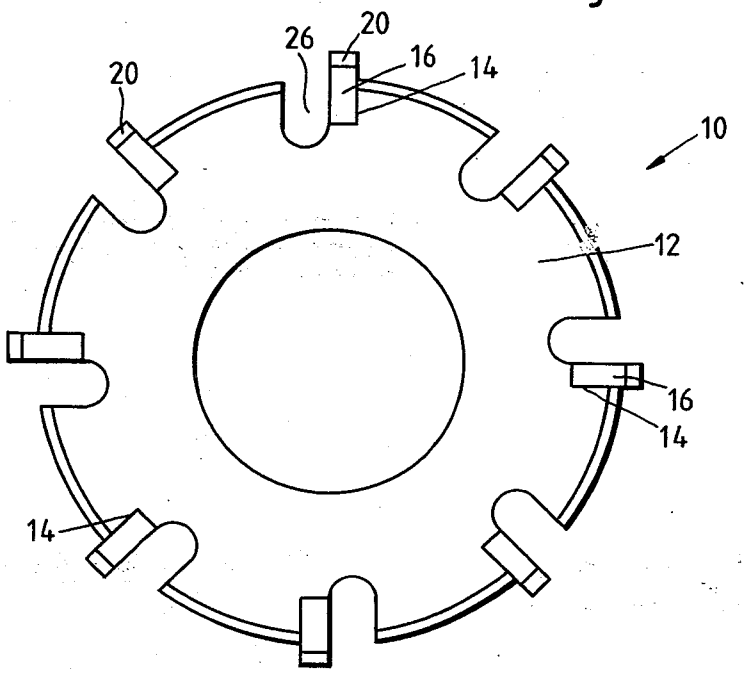

The present invention refers to a trueing tool.

The main functions of trueing tools for the dressing of working surfaces of grinding wheels are, on the one hand, the removal from the wheels of abrasive grains having become dull, and of metal particles clogging the working surface of the wheel during operation, and on the other hand, the restoration of the correct geometric shape of the grinding wheel. For this purpose it is well known in the art to use diamond tools as trueing tools. Thus there are available diamond single- and multi-grain trueing attachments, diamond trueing blocks and diamond trueing rollers. When using a trueing block, it can run underneath the grinding wheel where the levelling can take place in several runs at a feed-in of small depth. When trueing grinding wheels, the diamond trueing rollers perform a rotary motion preferably relative to the likewise rotating wheel, whereby the rotary motion preferably can be effected via a separate drive in both senses of rotation.

In the manufacture of diamond trueing rollers the art recognizes a positive and a negative method. By the positive method, diamond grain is applied to a basic body being accurate to size and bound by galvanic metal deposit. By this method diamond trueing rollers can be manufactured with limited accuracy only. By the negative method one obtains a better dimensional accuracy. Thus diamonds are placed by hand and with galvanic metal deposit or sintered metal in a molding ring of which the inner mold corresponds exactly to the trueing roller to be manufactured, and subsequently bound in different ways. After removal of the moulding ring, one will have a trueing roller of which the outer contours correspond exactly to the desired profile.

By using different diamond grain sizes and manufacturing techniques as well as different metallic or plastic bonds, one can make diverse types of trueing rollers. Thereby the diamond trueing rollers, with the exception of but a few, are coated with one layer of diamond grains only, covering the total surface of the trueing roller, thus presenting a sealed surface.

It is the object of the present invention to furnish a trueing tool that guarantees an extremely high geometric accuracy for the dressed grinding wheels and in addition thereto, a sharpness increasing the service life of the grinding wheels. Further, a trueing tool is provided of which the feed motion relative to the grinding wheel to be dressed, as compared to the known trueing tools, is increased in order to reduce the trueing time considerably.

According to the present invention, this object is achieved in that the profile of the trueing tool is composed of profiled plates of hard or superhard material, being arranged at a distance to each other. The hard or superhard material is preferably polycrystalline, synthetic diamond or cubic-crystalline boron nitride or hard metal, e.g. in the form of wolfram compounds or titanium compounds or ceramics, where in the embodiment of the invention the plates consist of a compact unit of the hard or superhard material, or of a basic body provided with a coating of the material, showing the profile. If coated basic bodies are used as profiled plates, known methods can be applied as e.g. electrolytic coating or sputtering, which are used for diamond or hard metal or ceramic cutting material.

A trueing tool according to the invention in the form of a trueing roller is noticeable for its segments, e.g. configured like teeth, being arranged at a distance to each other on the circumferential surface of a shaft body, and the breast surfaces of such segments being provided with the profiled plates of hard or superhard material. Preferably the profile of the trueing roller is composed of the front surfaces of the profiled plates made of hard or superhard material of preferably two teeth. This is especially of advantage if one breast surface of a tooth is composed of several profiled plates of synthetic diamond, in case these are not available in any size. Then the profiled plates of successive teeth are arranged staggered against one another, in order to obtain an overlapping. This will provide the advantage that during the trueing operation, the joint of adjacent plates will not be present. In a further embodiment of the invention, chip chambers are arranged in front of the breast surfaces in the shaft body, in order to receive metal particles and abrasive grains resulting from the dressing of the grinding wheel, as otherwise expensive devices for removing the same would be required.

When having a trueing tool in the form of a trueing block, according to the invention it is proposed to mount profiled plates of hard or superhard material, being arranged on projections and at a distance to each other, on a basic body, said plates defining the profile of the trueing block. Thereby the profile surface is preferably composed of profiled plates of hard or superhard material arranged at least on two projections, if more than one plate forms the front surface of a projection. At the same time it is recommended to provide chip chambers in front of the projections.

In order to obtain desired profiles with polycrystalline, synthetic diamond plates that are now on the market e.g. in the form of circular wheels of a thickness of 1.5 mm or 3.2 mm and a diameter of 13.7 mm, the plates are dressed by means of spark erosion, or an electron or laser beam, by a hot oxygen jet, or by grinding or shaping, e.g. by pressing.

Figure 2:
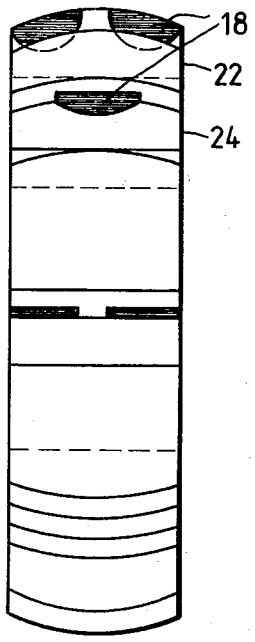
Figure 3:
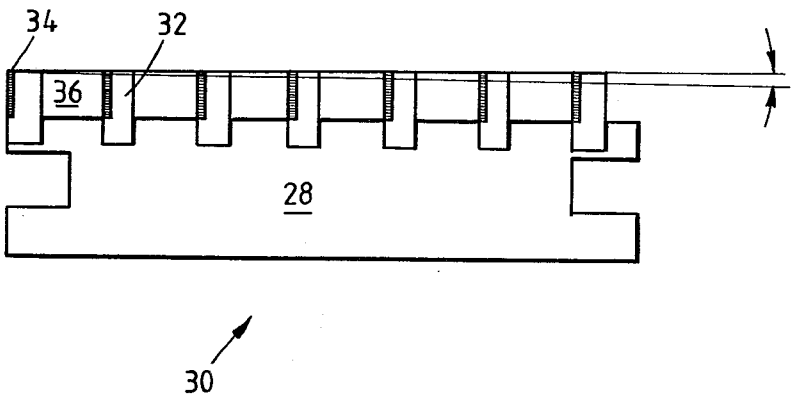
Figure 4:
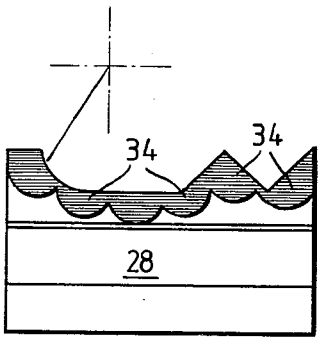

Further details, advantages and characteristics of the invention will result from the following description of the drawing, wherein FIG. 1 is a side view of a trueing tool according to the invention in the form of a trueing roller, FIG. 2 is an end view of the trueing tool according to FIG. 1, FIG. 3 is a side view of a trueing block, and FIG. 4 is an end view of the trueing block according to FIG. 3.

In FIG. 1 there is represented a trueing roller 10 according to the invention, which consists of a shaft body 12, having eight segments 14 in this embodiment. Hard metal plates 16 are arranged on the breast surfaces of the segments 14. In the top area of each of these plates a supporting material 20 is fixed serving to hold the profiled plates 18 of polycrystalline, synthetic diamond. The supporting material 20 is preferably made in the form of a hard metal support. Of course any cutting material other than polycrystalline, synthetic diamond can be used and likewise can be arranged immediately on the breast surfaces.

As illustrated in FIG. 2, very often there are arranged more than one diamond plate 18 (filled in area) on a breast surface of a segment 14, in order to furnish a desired profile. So that the joint between the synthetic diamond plates 18 will not influence the geometric accuracy during the trueing of grinding wheels, i.e. that the joint, for example, does not cause an undesired indentation or elevation on the grinding wheel, the diamond plates 18 on successive segments 14 are staggered with respect to each other. Thereby an overlapping takes place in the area of the joint when the trueing roller is rotating, so that an extremely precise geometric accuracy of the grinding wheel is also guaranteed after that. As illustrated by FIG. 2, two synthetic diamond plates 18 are arranged on a segment 22, whereas on the following segment 24 there is provided one diamond plate 18 only, being arranged exactly in the joint area of the plates 18 of the preceding segment 22.

Although in the first embodiment a simple profile is shown defined by the diamond plates 18, this can of course be shaped in any other manner. In order to process the diamond plates appropriately for the manufacture of a desired profile, according to the invention it is suggested to treat the diamond plates by means of spark erosion or by means of an electron or laser beam or a hot oxygen jet and appropriately water under high pressure, or by grinding or shaping, e.g. by pressing. This will guarantee a high precision of the profiles of the diamond plates 18, so that when using the trueing tool 10 according to the invention, the user will have a working surface of the grinding wheel, which is remarkable not only for its geometric accuracy but also for its extremely high sharpness with a resulting longer service life.

In order to remove the worn out blunted abrasive grains and metal particles resulting from the dressing of a grinding wheel in an easy manner, a chip chamber 26 is provided in front of each of the segments 14, by which the respective particles can be received. The expensive removal of the respective particles is not required as when using conventional trueing tools with trueing rollers provided with continuous surfaces coated with diamond grains.

In FIG. 3 there is shown the side view of a trueing block 30 presenting projections 32, on the breast surfaces of which cutting elements 34 are arranged. These cutting elements 34 are hard or superhard materials, consisting of a compact unit in the form of finish-profiled plates or of basic bodies coated with the cutting material. Thereby the projections 32 can be an integral part of the basic body 28, or can be fixed thereon.

In the embodiment according to FIG. 3 profiled plates of polycrystalline, synthetic diamond, are connected with the basic body 28 by means of a supporting material (which at the same time forms the projections). Like the trueing roller 10, the trueing block 28, too, is provided with chip chambers 36 in front of the projections.

FIG. 4 is an end view of the trueing block 30 according to the invention and makes clear that the profile surface of a projection is composed of several processed plates of hard or superhard material.

With the trueing roller as well as the trueing block according to the invention there will be the further advantage of a subsequent dressing without any difficulties, since the profiled plates of the cutting material arranged on the breast surfaces can be reprofiled and eventually replaced.

I claim:

1. In a trueing tool for dressing and maintaining the shape of the working surface of a grinding wheel to maintain a predetermined profile on said working surface and remove grinding contaminants therefrom, the combination comprising a trueing roller including a shaft body, a plurality of segments on the periphery of said body, each of said segments including a breast surface and a chip chamber formed on and partially defining said segment, means integrally securing at least one profiled cutter plate on each breast surface with the cutters of succeeding segments being displaced relative to the cutter on the preceding segment to cooperatively and sequentially define a predetermined profile on the working surface of said grinding wheel and to collect in successive chip chambers the portion of said working surface removed by said cutter when said trueing tool is engaged with said working surface of said grinding wheel, each of said cutter plates including a coating of hardened material harder than the substance of the plate.

2. The trueing tool defined by claim 1 wherein each of said cutter plates includes a profiled portion fabricated of hard materials selected from the group consisting of polycrystalline, synthetic diamond, cubic crystalline boron nitride, hardened metals in the form of wolfram compounds, titanium compounds and ceramics.

* * * * *